United States Patent [19]

Janson

[11] 4,384,190

[45] May 17, 1983

[54] CONTROL PANEL ARRANGEMENT FOR AN ELECTRIC SAUNA HEATING UNIT

[75] Inventor: Mats O. Janson, Port, Switzerland

[73] Assignee: Tylo Sauna S.A., Biel-Bienne, Switzerland

[21] Appl. No.: 163,312

[22] Filed: Jun. 26, 1980

[30] Foreign Application Priority Data

Sep. 25, 1979 [SE] Sweden ..... 7907952

[51] Int. Cl.[3] ..... A61H 33/06; F24H 9/20; H05B 1/02

[52] U.S. Cl. ..... 219/365; 4/524; 128/367; 219/272; 219/362; 219/364; 219/367; 219/374; 236/51

[58] Field of Search ..... 219/361–370, 219/271–276, 324–326; 4/524–535; 128/367, 368; 236/51

[56] References Cited

U.S. PATENT DOCUMENTS

| | | | |
|---|---|---|---|
| 2,228,074 | 1/1941 | Clark | 236/51 X |
| 2,277,845 | 3/1942 | Clark | 236/51 X |
| 2,722,594 | 11/1955 | Kueser | 219/370 X |
| 3,105,892 | 10/1963 | Knapp | 219/362 |
| 3,530,277 | 9/1970 | Kujansuu | 219/365 |

FOREIGN PATENT DOCUMENTS

| | | | |
|---|---|---|---|
| 822772 | 9/1969 | Canada | 219/365 |
| 426181 | 3/1935 | United Kingdom | 219/364 |
| 1065662 | 4/1967 | United Kingdom | 219/365 |

*Primary Examiner*—A. Bartis

*Attorney, Agent, or Firm*—Holman & Stern

[57] ABSTRACT

A sauna heating unit has a pair of upstanding spaced casings together forming an inner and an outer air space. Electric heating elements are arranged in the inner air space and are controlled by an on-off switch and temperature control regulator located in a ventilated connection box positioned below the inner air space and shielded therefrom by a roof-shaped housing member. A control panel having a triangular box-shaped member with an upwardly facing top face protrudes outwardly from the upper part of the outer casing. An on-off and a temperature control knob are mounted on the upper surface of the face and are connected to the switch and regulator, respectively, by shafts extending obliquely downwardly through the control panel, outer air space and roof-shaped housing into the connection box, thereby making operation of the switch and adjustment of the temperature regulator convenient and easy.

1 Claim, 3 Drawing Figures

CONTROL PANEL ARRANGEMENT FOR AN ELECTRIC SAUNA HEATING UNIT

BRIEF SUMMARY OF THE INVENTION

The present invention refers to an electric sauna heating unit.

Conventional sauna heating units are controlled via a control panel arranged outside the sauna room. Such a control panel comprises regulators such as thermostats or thermistors, a timer for automatically switching on and off the heater, signal lamps etc, which may not be subjected to high temperatures or moisture. There are also sauna heating units where the regulators as well as the control panel are arranged in the lower part of the heater, where the temperature around the heater is lower than elsewhere. The control panel is then arranged so low that one can only with difficulty in a kneeling position make the adjustments, which involves risks when the heating unit is switched on and gives out strong heat. It has hitherto been a common opionion that a control panel cannot be arranged at the upper part of the sauna heating unit, since the temperature there is considerably higher than permitted and since the electric components would be exposed to water and steam when water is poured over the sauna stones. A further drawback of arranging the control panel at the lower part of the heating unit is that protective rails, benches or similar devices cannot be placed in front of the heating unit, which often is necessary in the very limited space a sauna room offers.

A further drawback of arranging the control panel outside the sauna room is that one cannot observe whether there are any inflammable objects lying on top of the heating unit when it is switched on. Moroever, it is impossible to switch off the heating unit from inside the sauna room if e.g. the door to the sauna room for any reason cannot be opened from inside. Also the electric installation as well as the building work for the sauna will be expensive, since the wires have to be drawn through the wall and the control panel has to be recessed in the outer wall of the sauna room.

An object of the invention is to provide a sauna heating unit of the kind stated in the introduction and which does not have the above mentioned drawbacks. The objects are therefore to provide a sauna heating unit, which in a simple way can be controlled from inside the sauna room even if protective rails or benches are arranged in front of the heating unit, which is resistant against high temperatures, water and steam and which is cheap to manufacture and to maintain.

The sauna heating unit according to the present invention, which fulfils the above objects, comprises at least double casings spaced from each other and together forming an inner and an outer air space, electric heating elements arranged in said inner air space, a control panel having an on-off switch knob and a temperature control knob, said control panel protruding outwardly from the upper part of the outer casing and having a triangular box-shaped configuration, a ventilated connection box arranged in the lower part of the heating unit, on-off temperature regulators arranged in said connection box, a roof-shaped housing over said regulators and shafts arranged to extend through the outer air space and control panel and connecting the knobs on the control panel to the respective regulators.

BRIEF DESCRIPTION OF THE DRAWINGS

The invention will now be further described with reference to the accompanying drawings wherein.

DETAILED DESCRIPTION

Figure 1:
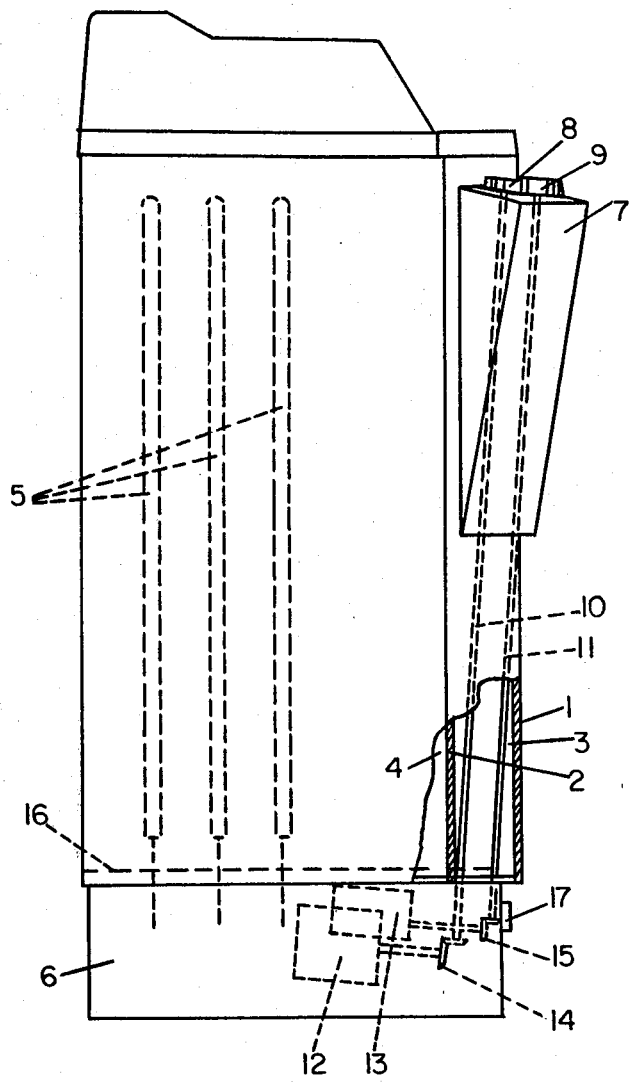
FIG. 1 is a side elevation view of a sauna heating unit according to the invention with parts cut away and shown in section.

With reference to FIG. 1 the sauna heating unit comprises an outer casing 1 and at least one inner casing 2 spaced from the outer casing. Both casings encase air spaces 3 and 4 open at the top and the bottom, electric heating elements 5 being arranged in the inner air space 4 as well as preferably a stone container serving as a steam generator when water is poured over the stones. A connection box 6 for the electric connections to the heating elements 5 is arranged in the lower part of the heating unit.

A triangular box-shaped control panel 7 with knobs 8 and 9 for an on-off switch and temperature control, respectively, and graduated scales (not shown) is arranged at the upper part of the heating unit on the outer casing 1 at the front or on one side depending on the local conditions. The knobs 8 and 9 are through shafts 10, 11 connected to regulators 12 and 13 in the connection box 6 through a bevel gear 14, 15 respectively. The shafts 10, 11 are located in the air space 3 between the outer and inner casings 1, 2. The regulators 12, 13 as well as other electric components will be protected against water through a roof-shaped housing 16. Cooling air is however permitted to penetrate through vents 18, for example, in the sides of the connection box 6. A signal lamp is denoted by 17.

Heat is transferred away from the electric components as well as from the knobs on the control panel through said shafts. The air in the air space 3 cools down the shafts, which cool down the knobs and the components.

Figure 2:
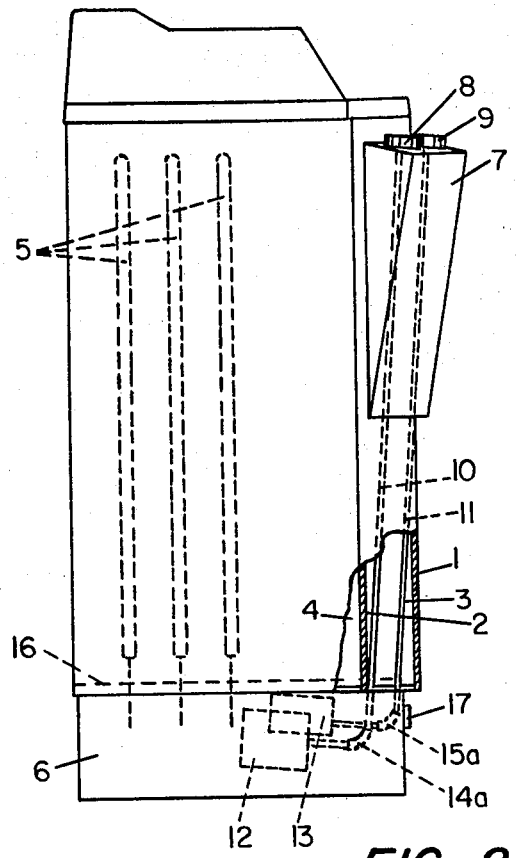
FIG. 2 is a side view of a modified embodiment of the invention of FIG. 1.
Figure 3:
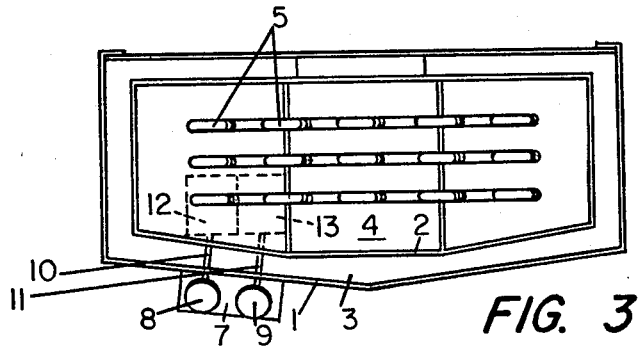
FIG. 3 is a top plan view of the sauna heating unit.

In the embodiment according to FIG. 2 the rotary connection from the shafts 10, 11 to the regulators 12, 13 is obtained through flexible shafts **14*a*, 15*a* or similar devices arranged in tubes. There could also be arranged flexible shafts or similar devices directly from the knobs 8, 9 to the regulators 12, 13**.

The invention provides a simple and cheap construction, which is very reliable and which can be subjected to high temperatures, moisture and steam.

What I claim is:

1. A sauna heating unit comprising at least two upstanding casings spaced from each other and together forming an inner and an outer air space, electric heating elements arranged in said inner air space, a control panel comprising a triangular box-shaped member having a substantially upwardly facing face protruding outwardly from the upper part of the outer casing and an on-off knob and a temperature control knob mounted on the upper surface of said face, a ventilated connection box arranged in the lower part of the heating unit, regulators comprising an on-off switch and a temperature control means arranged in said connection box, a roof-shaped housing member disposed over said regulators to shield them from said inner air space and shafts extending obliquely, downwardly through said control panel, the outer air space and said roof-shaped housing into said connection box operably connecting the knobs on the control panel to the respective regulators so that said regulators are controlled by said knobs.

* * * * *